United States Patent [19]

Wintringham

[11] 3,941,954

[45] Mar. 2, 1976

[54] MAGNETIC CAPTIVE KEY SWITCH LOCK

[76] Inventor: Robert E. Wintringham, 3049 Calle Rosales, Santa Barbara, Calif. 93105

[22] Filed: Sept. 10, 1974

[21] Appl. No.: 504,760

[52] U.S. Cl. ..... 200/44; 70/276; 70/339; 70/358; 70/389

[51] Int. Cl.[2] H01H 27/08; E05B 47/00; E05B 35/08

[58] Field of Search ..... 70/265, 276, 389; 200/44

[56] References Cited

UNITED STATES PATENTS

| | | | |
|---|---|---|---|
| 2,856,474 | 10/1958 | Norris | 200/44 |
| 3,518,855 | 7/1970 | Wake | 70/276 |
| 3,639,708 | 2/1972 | Wolniak et al. | 200/44 |
| 3,729,964 | 5/1973 | Hsu | 70/338 |

FOREIGN PATENTS OR APPLICATIONS

| | | | |
|---|---|---|---|
| 805,645 | 12/1958 | United Kingdom | 70/389 |

*Primary Examiner*—Albert G. Craig, Jr.
*Attorney, Agent, or Firm*—Clarence A. O'Brien; Harvey B. Jacobson

[57] ABSTRACT

A cylinder and plug type lock mechanism drivingly connects an authorized key to the actuator of a switch device and captivates the key when turning the switch on. A magnetic latch activated in the captive position of the key, prevents return of the key to its release position. A magnetic release element is positioned on the key against the lock mechanism to disengage the magnetic latch.

9 Claims, 16 Drawing Figures

MAGNETIC CAPTIVE KEY SWITCH LOCK

This invention relates generally to key operated lock mechanisms through which an operating device is actuated in an authorized manner.

The use of a lock mechanism to actuate an operating device such as a switch by means of a key, is well known as disclosed for example in U.S. Pat. Nos. 2,060,951 and 2,894,082 to Rae and Collotta respectively. Generally, an authorized key is inserted into the keyway of the plug in the lock mechanism only in the release position of the plug so that it may be rotated to actuate the switch by the key. The lock mechanism is designed to prevent withdrawal of the key in its actuated position but no facilities are usually provided to prevent return of the key and plug to the release position and withdrawal of the key once the switch has been actuated. Key captivating facilities are disclosed for example in U.S. Pat. Nos. 1,016,541 and 3,575,024 to Boone and Schlage. The captivating facilities disclosed in the Boone patent are rather cumbersome and do not offer any high degree of security whereas the captivating facilities disclosed in the Schlage patent are limited to capture of all unauthorized keys inserted into the keyway. U.S. Pat. Nos. 1,445,589 and 3,785,188 to Horiguchi and Drathschmidt, are also of interest in that they disclose magnetic facilities associated with key operated key mechanisms. However, the magnetic facilities associated with the lock mechanisms disclosed in the latter two patents are not related to any captive key arrangement through which withdrawal of an authorized key is permitted under control of authorized personnel only.

The captive key operated lock mechanism of the present invention is particularly suited for switch controlled operation of electrical devices such as television receivers that have heretofore been operated under control of coin receiving mechanism. By use of the present invention, a switch may be built into a key operated lock mechanism and actuated by a key inserted into the lock mechanism in its release position. Withdrawal of the key is prevented once it is turned to the on position of the switch device and a special release element must be utilized in order to release the key for return to its release position and withdrawal from the lock mechanism. Operation of the switch device by a key and capturing of the key in the lock mechanism is thus limited only to authorized keys. Further, the switch, the switch actuator and the lock mechanism together with the releasable latching facilities for capturing the key, are built into a single unitary assembly in accordance with the present invention.

The present invention is therefore associated with a conventional type of cylinder and plug lock mechanism with an axial extension on the cylinder for holding the fixed terminals of the switch device in operative relation to a floating contact assembly that is carried by a switch actuating driver coupled to the plug of the lock mechanism. Thus, the switch is actuated upon rotation of the plug by a inserted key from a release position, in which the key is inserted into the keyway of the plug to an actuated position, in which the key cannot be withdrawn from the plug. In the actuated position of the plug, magnetic latch elements mounted by a face cap member to which the cylinder is connected, are aligned with cavities or holes in a latching flange secured to the plug so as to be automatically projected into such holes by magnetic force for locking the plug in its actuated position and preventing it from being angularly returned to the release position. The magnetic latch is released by positioning a special magnetic release element over the key in abutment with the face cap member of the lock mechanism. Magnets embedded in the release element are thereby operatively aligned with the magnetic latch elements so as to effect their retraction from the latching flange of the plug and thereby permitting the plug to be rotated back to its release position by the key. The key may then be withdrawn.

These together with other objects and advantages which will become subsequently apparent reside in the details of construction and operation as more fully hereinafter described and claimed, reference being had to the accompanying drawings forming a part thereof, wherein like numerals refer to like parts throughout.

Figure 1:
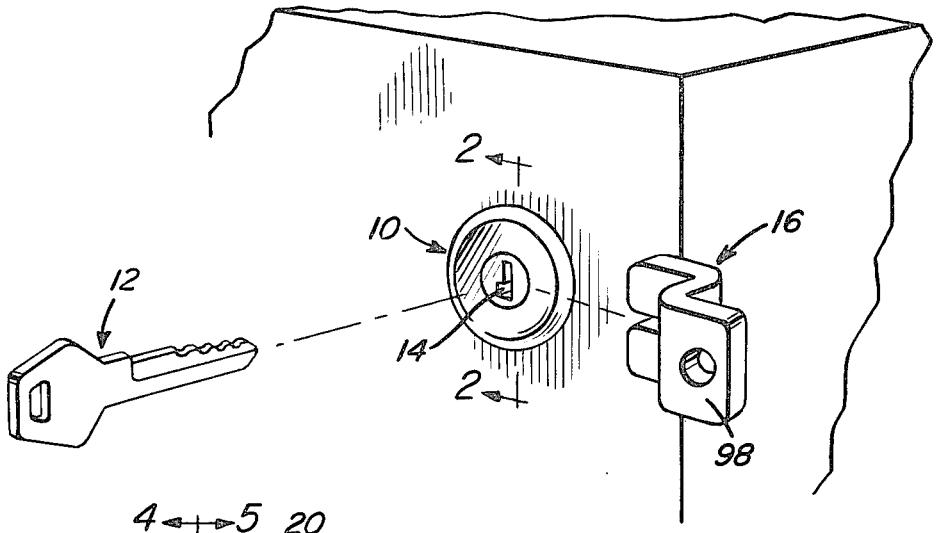
FIG. 1 is a perspective view showing the device of the present invention installed with an authorized key and a magnetic release element disposed adjacent thereto.

Referring now to the drawings in detail, FIG. 1 illustrates a lock and switch assembly generally referred to by reference numeral 10 installed on any desired appliance such as a television receiver through which the appliance may be activated by insertion of an authorized key 12 and rotation thereof by 90° in a clockwise direction for example. Once the key 12 is fully inserted into the keyway 14 of the assembly 10, and rotated 90°, it will be automatically captivated in that it cannot be withdrawn nor rotated back from its actuated position to the initial release position. In order to effect release of the key, a magnetic release element generally referred to by reference numeral 16 must be operatively positioned adjacent the lock mechanism over the key as will be explained hereafter in detail.

Figure 2:
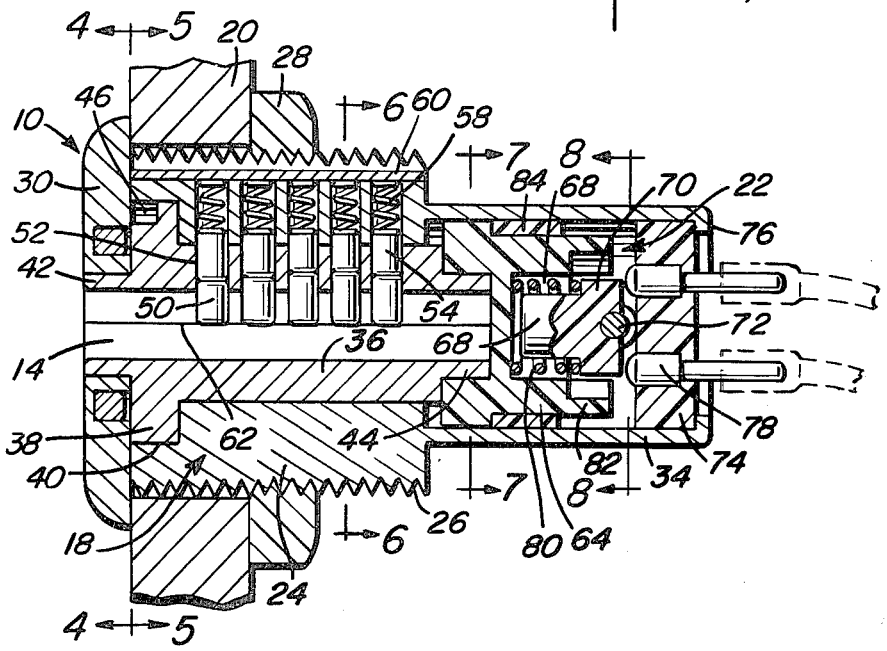
FIG. 2 is a longitudinal sectional view through the lock mechanism taken substantially through a plane indicated by section line 2—2 in FIG. 1.
Figure 9:
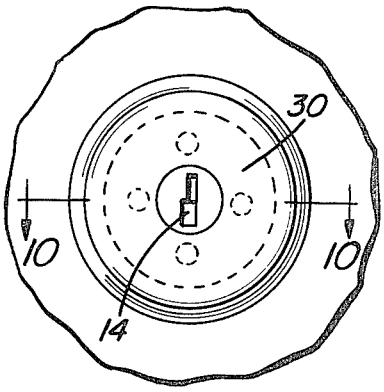
FIG. 9 is a front elevational view of the lock mechanism shown in FIG. 1.
Figure 11:
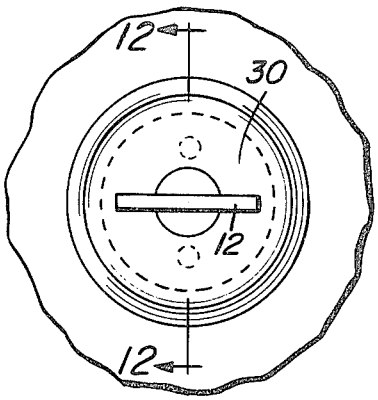
FIG. 11 is a front elevational view of the lock mechanism with an authorized key installed and rotated to an actuated position.
Figure 10:
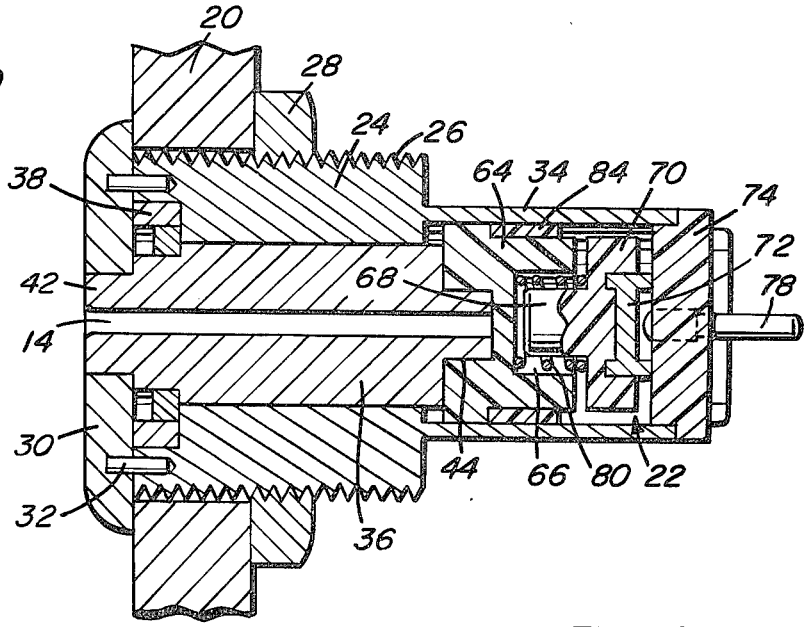
FIG. 10 is a top sectional view taken substantially through a plane indicated by section line 10—10 in FIG. 9.

As more clearly seen in FIGS. 2, 9 and 10, the lock and switch assembly 10 includes a lock mechanism 18 mounted in the wall 20 of the appliance and supporting at its inner end, an electrical switch device generally referred to by reference numeral 22. The lock mechanism 18 includes an outer cylinder 24 made of a non-magnetic or non-ferrous material and having external threads 26 on which a locknut 28 is received for clamping the cylinder to the wall 20 on the inside against a face cap member 30 secured to the cylinder in any suitable fashion after being coaxially aligned therewith by means of pins 32 as more clearly seen in FIG. 10. A diametrically smaller, tubular extension 34 of the lock cylinder encloses the switch device 22 in coaxial relationship to the lock cylinder and a lock plug 36 through which the keyway 14 extends.

Figure 5:
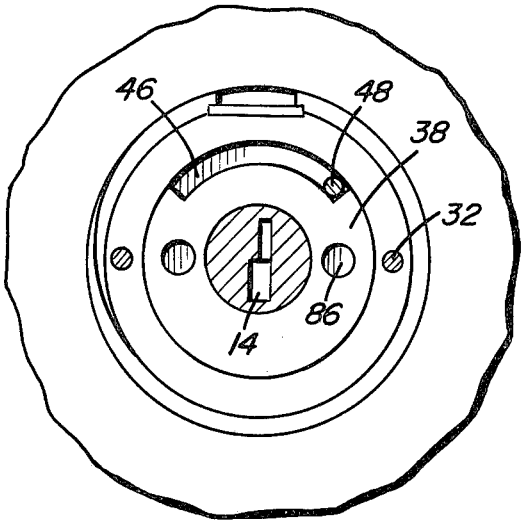
FIG. 5 is a transverse sectional view taken substantially through a plane indicated by section line 5—5 in FIG. 2.
Figure 7:
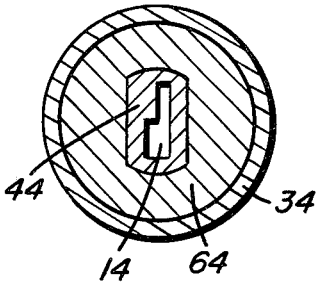
FIG. 7 is a transverse sectional view taken substantially through a plane indicated by section line 7—7 in FIG. 2.
Figure 8:
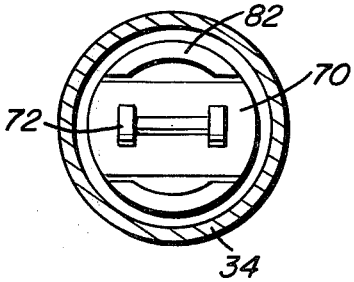
FIG. 8 is a transverse sectional view taken substantially through a plane indicated by section line 8—8 in FIG. 2.
Figure 16:
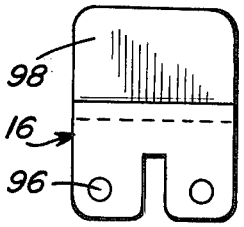
FIG. 16 is a front elevational view of the magnetic release element associated with the invention.
Figure 15:
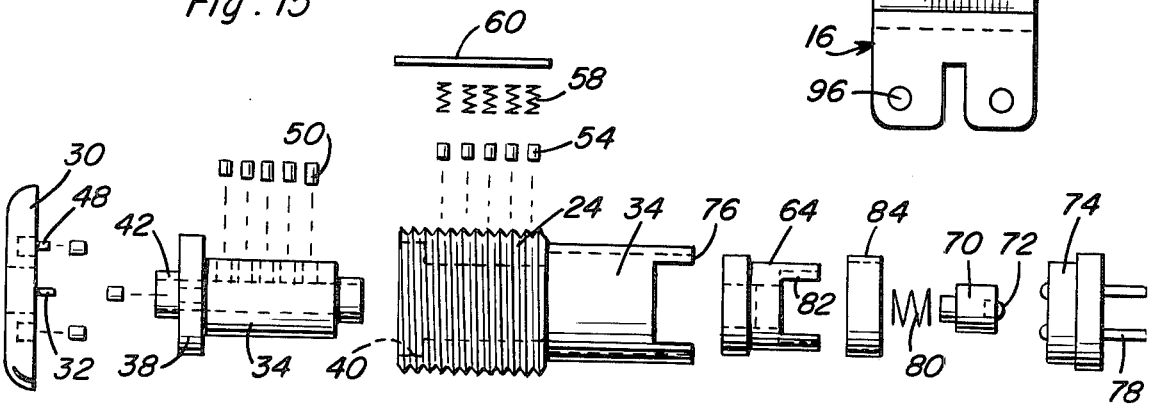
FIG. 15 is a side elevational view of the disassembled parts of the lock and switch assembly of the present invention.

The plug 36 is cylindrical in shape and coaxially mounted within the cylinder for rotation. An annular flange 38 is formed on the plug and received within an annular recess 40 formed at one axial end of the cylinder 24. A small diameter axial extension 42 of the plug is journaled within the face cap member 30 at one axial end of the plug while the opposite axial end is provided with a switch actuating driver formation 44 as more clearly seen in FIG. 7. In order to limit angular displacement of the plug 36 relative to the cylinder, an arcuate recess 46 is peripherally formed in the flange 38 as more clearly seen in FIGS. 2 and 5, the recess receiving a stop pin 48 which projects from the face plate member 30 fixed to the cylinder. The arcuate extent of the recess 46 is 90° to thereby limit angular displacement of the plug by this amount between a release position in which the key 12 is inserted and a captive position.

Figure 3:
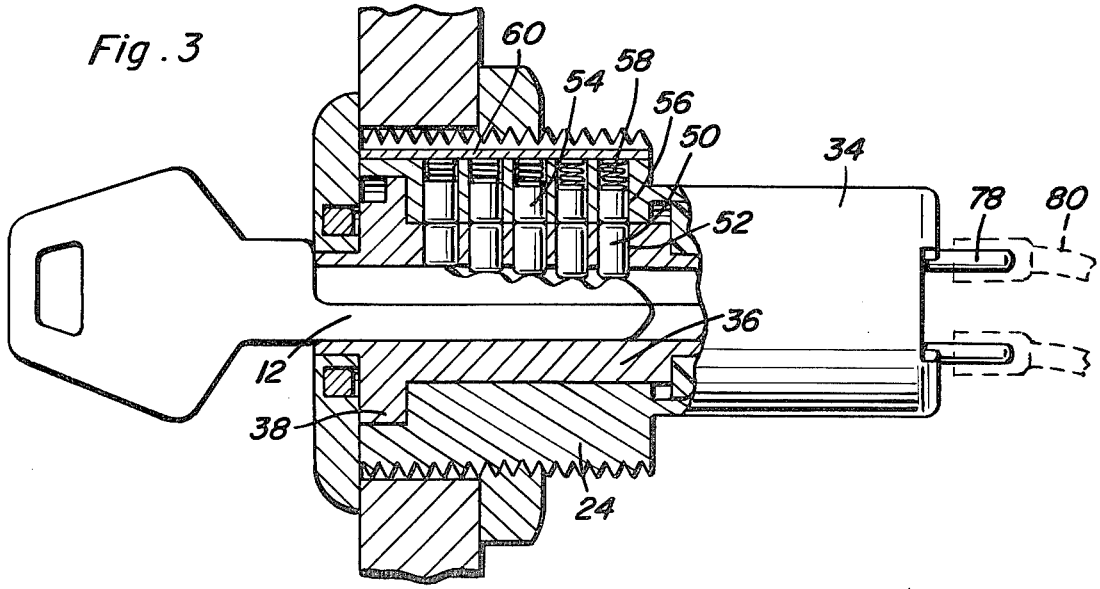
FIG. 3 is a partial side sectional view similar to FIG. 2 showing the key inserted in the release position of the lock mechanism.
Figure 4:
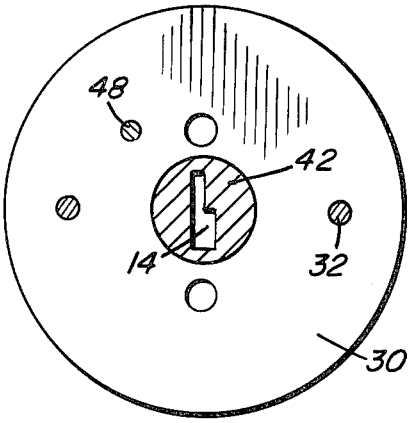
FIG. 4 is a transverse view taken substantially through a plane indicated by section line 4—4 in FIG. 2.
Figure 6:
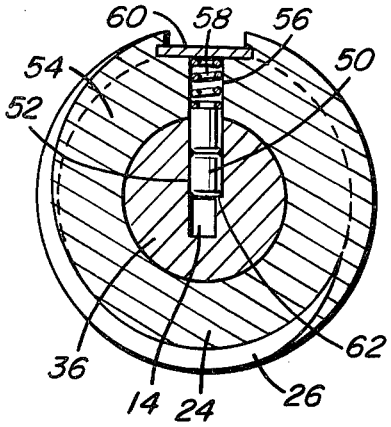
FIG. 6 is a transverse sectional view taken substantially through a plane indicated by section line 6—6 in FIG. 2.

The cylinder and plug are made of a non-magnetic, non-ferrous material. A plurality of non-magnetic plug pins 50 are slidably mounted in the plug in transverse relation to its longitudinal or rotational axis. The plug pins are adapted to project into the keyway 14 from transverse bores 52 formed in the plug. The edge notches on an authorized key 12 will accordingly position the plug pins 50 as shown in FIG. 3 so that the radially outer ends thereof will be flush with the cylindrical outer surface of the plug to thereby correspondingly position the cylinder pins 54 within the cylinder 24 as shown in FIG. 3. The cylinder pins 54 are also made of non-magnetic material and are biased radially inwardly within bores 56 by cylinder springs 58. Since the bores 56 are radially aligned with the bores 52 in the release position of the plug 36 as shown in FIG. 3, the key 12 may be inserted or withdrawn. However, when rotated to the actuated position, the bores 52 will no longer be aligned with the bores 56 so that no radially outward displacement of the plug pins 50 is possible. Withdrawal of the key is thereby prevented. The bores 56 in the cylinder are closed by a pin retainer plate 60 as more clearly seen in FIG. 6 against which the springs 58 react to inwardly bias the pins to the positions shown abutting the shoulder 62 in the keyway prior to insertion of the key 12.

The drive extension 44 of the plug is received within and thereby keyed to a switch actuating drive member 64 as more clearly seen in FIGS. 2 and 10. The drive member 64 is associated with the switch device 22 and is provided with a cavity 66 receiving a stub shaft portion 68 of a floating contact carrier 70 made of a non-conductive material. A floating contact assembly 72 made of a conductive material is carried at the axial end of the carrier 70 confronting a fixed terminal block 74 made of a non-conductive material and retained at the inner axial end of the cylinder extension 34 by the inturned retainer formations 76. A pair of fixed terminals 78 are embedded in the block 74 and project inwardly therefrom for engagement by the floating contact assembly 72 when rotated by 90 degrees from the position illustrated in FIG. 2. The other ends of the terminals 78 project outwardly from the assembly 10 and are adapted to be connected to electrical cables 80 as shown by dotted line. The contact assembly 72 is axially urged into engagement with the block and the projecting ends of the terminals 78 by the bias of a spring 80 seated within the cavity 66 of the actuator drive member 64 and reacting against the laterally extending portion of the carrier 70. Angular displacement is imparted to the carrier 70 by the arcuate extensions 82 of the drive member 64. The drive member 64 is coaxially positioned within the tubular extension 34 of the cylinder by means of an annular spacer 84 as shown in FIGS. 2 and 10.

Figure 12:
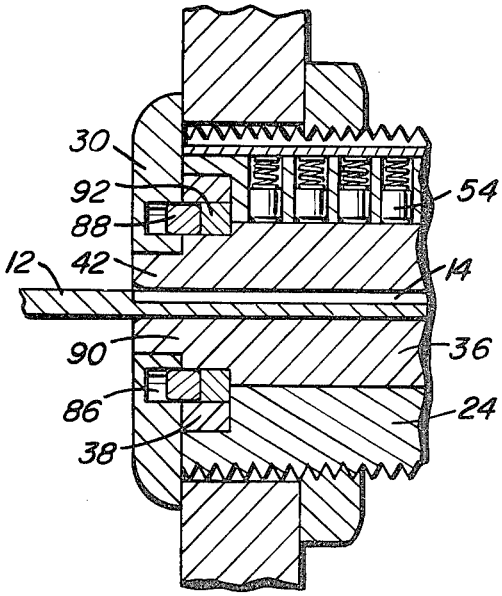
FIG. 12 is a partial side sectional view taken substantially through a plane indicated by section line 12—12 in FIG. 11.

Referring now to FIG. 12 in particular, the face cap member 30 is provided with a pair of diametrically opposed recesses 86 that open inwardly in confronting relation to the annular latching flange 38 of the plug. A pair of magnetic latch elements such as axially polarized magnets 88 are slidably positioned within the recesses or openings 86 and are adapted to be projected into cavities or holes 90 formed in the flange 38 when aligned with the magnetic elements 88 in the actuated position of the plug. Ferrous inserts 92 are fixedly seated within the cavities 90 of the flange 38 in view of the non-magnetic material from which the plug is made. Thus, the magnetic latch elements 88 are projected into the cavities 90 in the flange by magnetic force thereby angularly latching the plug to the fixed face cap member 30 to prevent it from being angularly displaced back to the initial release position. Thus, once a key is inserted into the lock mechanism and rotated 90° in order to actuate the switch device 22, it cannot be rotated back to the release position and withdrawn.

Figure 13:
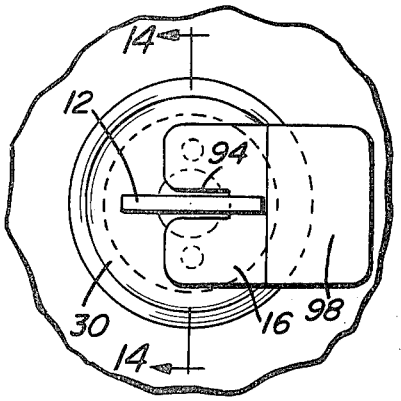
FIG. 13 is a front elevational view of the lock mechanism similar to that of FIG. 11 but with a magnetic release element in position.
Figure 14:
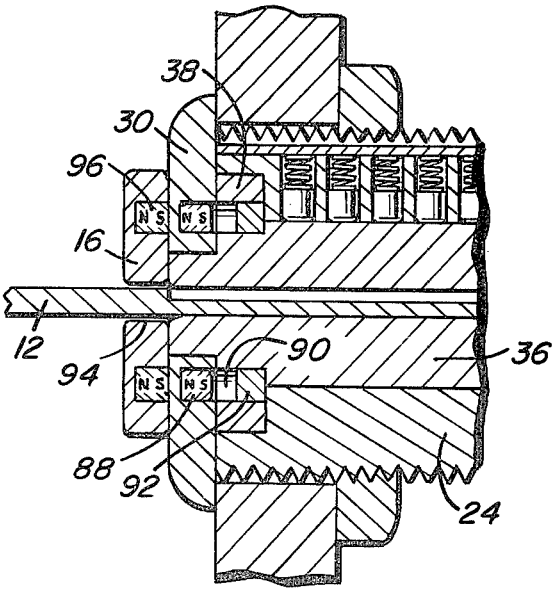
FIG. 14 is a partial side sectional view taken substantially through a plane indicated by section line 14—14 in FIG. 13.

In order to permit removal of the key, the magnetic latch is released by operatively positioning the magnetic release element 16 over the key in abutment with the face cap member 30 of the lock mechanism as shown in FIGS. 13 and 14. A slot 94 is accordingly formed in the release element so that it may straddle the key while abutting the face cap member. A pair of magnets 96 are embedded in the release element so that the flux emitting faces thereof may be brought into proximity to the movable magnetic latching elements 88 causing the same to be retracted from the cavities 90 into the holes 86 in the face cap member. The key and plug 36 may then be rotated back to the release position bringing the magnetic latch elements 88 out of alignment with the cavities 90. The release element 16 may then be withdrawn. An offset handle portion 98 is connected to the release element so that it may be manually held and applied.

It will be apparent from the foregoing, that an authorized key 12 when inserted into the lock mechanism will be drivingly connected to the switch device 22 and upon rotation of the key by 90° the floating contact assembly 72 of the switch device will engage the fixed terminals 78 thereby bridging the same to complete an electrical circuit for operating any electrical appliance such as a television receiver. In this actuated position, the key 12 cannot be withdrawn from the plug and the plug will be magnetically latched against rotation. The magnetic latch is automatically activated only in the actuated position of the plug because of the alignment of the magnetic latch elements 88 with the inserts 92 in the latching flange 38 of the plug. The latching elements 88 are withdrawn to disengage the magnetic latch by operative positioning of the magnetic release element 16 on the key in abutment with the face cap member 30. Only then may the key be rotated back to the release position and withdrawn thereby also disengaging the switch device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a lock mechanism having a tubular housing and a plug angularly displaceable by an authorized key from a release position in which said key is received in a keyway formed in the plug to a captive position in which the key cannot be withdrawn from the keyway, means for releasably preventing withdrawl of said key from the lock mechanism, comprising latch means automatically activated in response to positioning of the plug in the captive position for preventing angular displacement of the plug by said key to the release position, and release means operatively positioned in non-rotative relation on the key in the captive position of the plug for magnetically releasing the latch means to permit displacement of the plug to the release position.

2. The combination of claim 1 wherein said latch means includes a face cap member secured to the housing, a latch member secured to the plug in confronting relation to the face cap member, and a magnetic element movably mounted by one of said members, the other of said members having a cavity into which the magnetic element is projected by magnetic force only in the captive position of the plug.

3. The combination of claim 2 wherein said release means comprises a release element having a slot adapted to straddle the key in abutment with the face cap member, and a magnetic means embedded in the release element in operative alignment with the magnetic element in the captive position of the plug for retracting the magnetic element from the cavity.

4. The combination of claim 3 wherein said latch member comprises a flange connected to the plug in slide bearing contact with the face cap member and within which said cavity is formed when aligned with the magnetic element in the captive position of the plug.

5. The combination of claim 4 including fixed terminal means connected to the housing, a switch actuator drivingly connected to the plug and contact means carried by the actuator for engagement with the terminal means in only one of said positions of the plug.

6. The combination of claim 2 wherein said latch member comprises a flange connected to the plug in slide bearing contact with the face cap member and within which said cavity is formed when aligned with the magnetic element in the captive position of the plug.

7. The combination of claim 1 including fixed terminal means connected to the housing, a switch actuator drivingly connected to the plug and contact means carried by the actuator for engagement with the terminal means in only one of said positions of the plug.

8. In combination with an operating mechanism actuated through a lock mechanism by an authorized key in response to angular displacement thereof from an inactive position to an actuated position, said lock mechanism receiving said key in the inactive position and captivating the key in the actuated position, magnetic latch means automatically activated in the actuated position of the key for preventing return of the key to the inactive position and magnetic release means non-rotatively positioned on the key for disengaging the magnetic latch means in the actuated position.

9. The combination of claim 8 wherein said operating mechanism is a switch device.

* * * * *